US008114252B2

(12) United States Patent
Dykstra

(10) Patent No.: US 8,114,252 B2
(45) Date of Patent: Feb. 14, 2012

(54) PAPER MAKING COMPOSITIONS AND PROCESSES USING PROTEIN PARTICULATE, COLLOIDAL PIGMENT, AND LATEX POLYMER COMBINATIONS

(75) Inventor: Gerald M. Dykstra, Bartlett, TN (US)

(73) Assignee: Buckman Laboratories International, Inc., Memphis, TN (US)

( * ) Notice: Subject to any disclaimer, the term of this patent is extended or adjusted under 35 U.S.C. 154(b) by 683 days.

(21) Appl. No.: 12/170,655

(22) Filed: Jul. 10, 2008

(65) Prior Publication Data

US 2009/0014140 A1 Jan. 15, 2009

Related U.S. Application Data

(60) Provisional application No. 60/949,335, filed on Jul. 12, 2007.

(51) Int. Cl.

| | |
|---|---|
| ***D21H 17/02*** | (2006.01) |
| ***D21H 17/33*** | (2006.01) |
| ***D21H 17/63*** | (2006.01) |
| ***D21H 23/00*** | (2006.01) |
| ***D21H 23/04*** | (2006.01) |
| ***D21H 23/22*** | (2006.01) |

(52) U.S. Cl. ..... 162/160; 162/158; 162/168.1; 162/174; 162/181.1; 162/184; 162/185; 106/124.1; 106/417; 106/436; 106/465; 106/468; 106/469; 106/471; 106/491

(58) Field of Classification Search ..... 162/160, 162/164.1, 168.1, 181.1–181.8, 158, 174, 162/184, 185; 106/124.1, 417, 436, 465, 106/468, 469, 471, 491; 524/17
See application file for complete search history.

(56) References Cited

U.S. PATENT DOCUMENTS

| | | | | |
|---|---|---|---|---|
| 3,288,632 | A | | 11/1966 | Rush et al. |
| 3,664,912 | A | * | 5/1972 | Olson ..... 428/198 |
| 4,294,704 | A | | 10/1981 | Daniel et al. |
| 5,169,884 | A | * | 12/1992 | Lindemann et al. ..... 524/44 |
| 5,292,781 | A | | 3/1994 | Floyd |
| 5,709,976 | A | * | 1/1998 | Malhotra ..... 430/124.54 |
| 5,766,331 | A | | 6/1998 | Krinski et al. |
| 5,830,241 | A | * | 11/1998 | Rohringer et al. ..... 8/552 |
| 6,030,443 | A | | 2/2000 | Bock et al. |

FOREIGN PATENT DOCUMENTS

EP 0712960 A1 5/1996

OTHER PUBLICATIONS

Definition of coloid, Websters II New Riverside Dictionary, Houghton Mifflin Company, 1988, p. 282.*
Smook, Gary A., Handbook of Pulp and Paper Terminology, Angus Wilde Publications, 1990, p. 56.*
Smook, Gary A., Handbook for Pulp and Paper Technologies, 2nd ed, Angus Wilde Publications, 1992, pp. 287-288.*
J. Peel, Paper Science & Paper Manufacture 1999, pp. 18-19.*
Smook, Gary A., Handbook for Pulp and Paper Technologists, 2nd ed, Angus Wilde Publications, 1992, p. 225.*
Li et al., "Enhancing Wet Cellulose Adhesion with Proteins," Ind. Eng. Chem. Res., No. 44, 2005, pp. 7398-7404.
Notification of Transmittal of the International Search Report and the Written Opinion of the International Searching Authority for corresponding International Patent Application No. PCT/US2008/069597 dated Nov. 6, 2008 (12 pages).

* cited by examiner

*Primary Examiner* — Matthew Daniels
*Assistant Examiner* — Dennis Cordray
(74) *Attorney, Agent, or Firm* — Kilyk & Bowersox, P.L.L.C.

(57) ABSTRACT

A composition for treating paper products comprising protein particulate, colloidal pigment, synthetic latex polymer, and preservative is described, as well as methods and an apparatus using the composition for such treatments, and products obtained thereby. The treated paper products preferably have improved strength, water holdout, and/or ink holdout, amongst other advantages and benefits.

25 Claims, 2 Drawing Sheets

PAPER MAKING COMPOSITIONS AND PROCESSES USING PROTEIN PARTICULATE, COLLOIDAL PIGMENT, AND LATEX POLYMER COMBINATIONS

This application claims the benefit under 35 U.S.C. §119(e) of prior U.S. Provisional Patent Application No. 60/949,335, filed Jul. 12, 2007, which is incorporated in its entirety by reference herein.

BACKGROUND OF THE INVENTION

The present invention relates to paper treatment compositions, paper making methods, and apparatus using the compositions, and paper and paperboard products made using them. More particularly, the present invention relates to a dispersion comprising protein particulate, colloidal pigment, synthetic latex polymer, and preservative, which is useful for improving strength and surface properties of paper products when used as a surface coating and/or internal additive thereof.

Conventional paper making processes generally comprise the following steps: (1) forming an aqueous suspension of cellulosic fibers, commonly known as pulp; (2) adding various processing and paper enhancing materials, such as strengthening and/or sizing materials; (3) sheeting and drying the fibers to form a desired cellulosic web; and (4) post-treating the web to provide various desired characteristics to the resulting paper, including surface application of sizing materials, and the like.

A need has existed for additives for paper processing that produce a paper or paperboard product with improved strength and liquid holdout characteristics.

SUMMARY OF THE INVENTION

A feature of the present invention is to provide compositions for treating paper products, where the compositions comprise a protein particulate, a colloidal pigment, a synthetic latex polymer, and a preservative. In another feature, the composition further includes a pigment extender that does not detract from paper strength. Methods and apparatus using these compositions for such paper treatments, and treated paper products obtained thereby, are also provided.

Additional features and advantages of the present invention will be set forth in part in the description which follows, and in part will be apparent from the description, or may be learned by practice of the present invention. The objectives and other advantages of the present invention will be realized and obtained by means of the elements and combinations particularly pointed out in the written description and appended claims.

To achieve these and other advantages and in accordance with the purposes of the present invention, as embodied and broadly described herein, the present invention relates to compositions useful in paper and board manufacture to both internally and/or externally size paper, wherein the compositions comprise at least one protein particulate, at least one colloidal pigment, at least one synthetic latex polymer, and at least one preservative. They may further include at least one extender. Among other advantages and benefits, the compositions impart improved dry/wet strength, water holdout, and/or ink holdout properties to the paper or paper board. It has been found that the protein particulate, colloidal pigment, synthetic latex polymer, and preservative, as used in combination per compositions of the present invention, reduce or even eliminate problems that otherwise tend to be associated with use of each these ingredients by itself or in lesser combinations thereof. For example, the inventive compositions provide stable dispersions of the protein particulate, provide improved water/ink holdout and/or strength properties using dispersions containing the colloidal pigment, and/or improve repulpability of paper products made with dispersions containing the synthetic latex polymers. A preservative can be included since the protein-containing compositions are biopolymer dispersions subject to microbial degradation. A preservative, for example, a mild food preservative, can be contained in an effective antimicrobial amount in compositions of the present invention. It also has been discovered that certain filler materials can be used to extend the pigment, a relatively higher cost ingredient, without detracting from the strength of the paper made with the composition.

In one embodiment, the compositions comprise from about 20 to about 40 weight % protein particulate, from about 20 to about 40 weight % colloidal pigment, from about 20 to about 40 weight % synthetic latex polymer, from about 0.1 to about 2.0 weight % preservative, on a total dry weight basis of the composition. In another embodiment, where a portion of the colloidal pigment is replaced by extender, there is a composition comprising from about 20 to about 40 weight % protein particulate, from about 10 to about 30 weight % colloidal pigment, from about 20 to about 40 weight % synthetic latex polymer, from about 0.1 to about 2.0 weight % preservative, and from about 5 weight % to about 30 weight % pigment extender, on a total dry weight basis of the composition.

The protein particulate may comprise legume particles, powders, and/or flours, and preferably may be defatted soybean flour. The colloidal pigment may be silicates, calcium carbonate, calcined kaolin, hydrous kaolin, China clay, talc, mica, dolomite, silica, zeolite, gypsum, satin white, titania, titanium dioxide, calcium sulfate, barium sulfate, aluminum trihydrate, lithopone, blanc fixe, plastic pigment, or combinations thereof. The synthetic latex polymer may be styrene butadiene copolymer, carboxyl styrene-butadiene copolymers, styrene acrylate, styrene acrylonitrile, vinyl acrylate, acrylic, polyvinyl acetate, vinyl polyacetates, carboxyl vinyl polyacetates, alkyl acrylate-vinyl acetate copolymers or carboxyl alkyl acrylate-vinyl acetate copolymers, or combinations thereof. The preservative may be selected, for example, from isothiazolines, propyl 4-hydroxybenzoate, butylated hydroxyanisole, or combinations thereof. The pigment extender may comprise calcium silicate and synthetic or natural sources thereof, for example, Wollastonite.

In another embodiment, a method is provided for treating paper or paper board by applying the composition comprising an aqueous dispersion comprising protein particulate, colloidal pigment, and synthetic latex polymer, to at least one of, i) at least one surface of a formed paper or paper board sheet, ii) a paper or paper board making pulp prior to draining. The composition is readily dispersible throughout a coating, or papermaking pulp or cellulosic suspension. As a surface treatment, the composition preferably is applied to a paper surface after the paper is formed in a size press, such as via a coater, or other suitable application equipment, using application techniques well known to those skilled in the art. The composition may be applied to at least one surface of a base paper at a coating rate of about 0.5 g/m$^2$ to about 40 g/m$^2$, on a dry weight basis. Where the composition is internally added to paper or paper board, addition may be achieved by incorporating the composition into papermaking stock prior to draining on the machine wire, and then forming the treated pulp into paper or paperboard. The composition may be added to the pulp in an amount of at least about 0.1 dry pound per ton of pulp, based on the dried solids weight of the pulp, particularly from about 0.25 to about 5 dry pounds per ton, more particularly from about 0.5 to about 1.5 dry pounds per ton, and even more particularly from about 0.8 to about 1.2 dry pounds per ton, in paper furnish.

In yet another embodiment, paper or paperboard products are provided that have been made with compositions used in methods of the present invention. For instance, a coated paper product is provided that is produced using an aqueous composition comprising an aqueous dispersion comprising protein particulate, colloidal pigment, and synthetic latex polymer, wherein the composition is applied to at least one surface of a base paper sheet at a coating rate of from about 0.5 $g/m^2$ to about 40 $g/m^2$, on a dry weight basis. A treated paper product is made from a drained paper web formed of a treated pulp comprising cellulosic fibers and a dispersion comprising protein particulate, colloidal pigment, and synthetic latex polymer, in which the resulting pulp has been drained, dried and formed into a sheet of pulp, having improved strength, ink/water holdout, and/or retention properties imparted by treatment from the composition presented herein, as compared to conventional treatments.

It is to be understood that both the foregoing general description and the following detailed description are exemplary and explanatory only and are only intended to provide a further explanation of the present invention, as claimed. The accompanying drawings, which are incorporated in and constitute a part of this application, illustrate several embodiments of the present invention and together with description, serve to explain the principles of the present invention.

DETAILED DESCRIPTION OF THE PRESENT INVENTION

The present invention relates to compositions for improvement of strength and surface properties of paper and paperboard. As used herein, the term "paper" includes all grades of paper and board. The combination of protein particulate with certain colloidal pigments and synthetic polymer latex has been found to form stable, non-setting dispersions that improve dry strength, wet strength, water holdout, and/or ink holdout properties, inter alia, of paper and paperboard when used as surface and/or internal additives.

These biopolymer dispersions may be used as a surface treatment alone or in combination with known surface sizing or surface strength additives. The biopolymer dispersions also may be used as internal additives alone or in combination with known internal sizing or internal dry-wet strength additives. These compositions also work well in conjunction with retention and drainage polymers.

Protein flours per se, such as defatted soy flours, do not form stable dispersions. Colloidal pigments alone do not improve or only very slightly improve holdout of inks or water and do not improve or only slightly improve the strength properties of paper or paperboard. Synthetic latex polymers alone often cause picking problems in surface treatment of paper and paperboard due to the thermoplastic properties of many latex polymers. Synthetic latex polymers alone as strengthening or surface additives can cause repulping problems at higher internal use levels or surface use levels when machine broke from paper and paperboard is repulped. However, in combination according to embodiments of the present invention, compositions of protein particulate, certain colloidal pigments, and synthetic polymer latex reduce or avoid these shortcomings that may be associated with the individual components. A preservative can be also included since the protein-containing compositions are biopolymer dispersions subject to microbial degradation. It also has been discovered that certain filler materials can be used as pigment extenders to replace at least a portion of the pigment, which is a relatively higher cost ingredient, in the formulation without detracting from the performance of the formulation in paper production.

Papermaking Processing. The methods of the present invention can be practiced on conventional paper making machines, such as a Fourdrinier type paper machine, with modifications that can be easily made in view of the present invention. A flow chart of a paper making system for carrying out methods of the present invention is set forth in FIG. 1. It is to be understood that the system shown is exemplary of the present invention and is in no way intended to restrict the scope of the invention.

Figure 1:
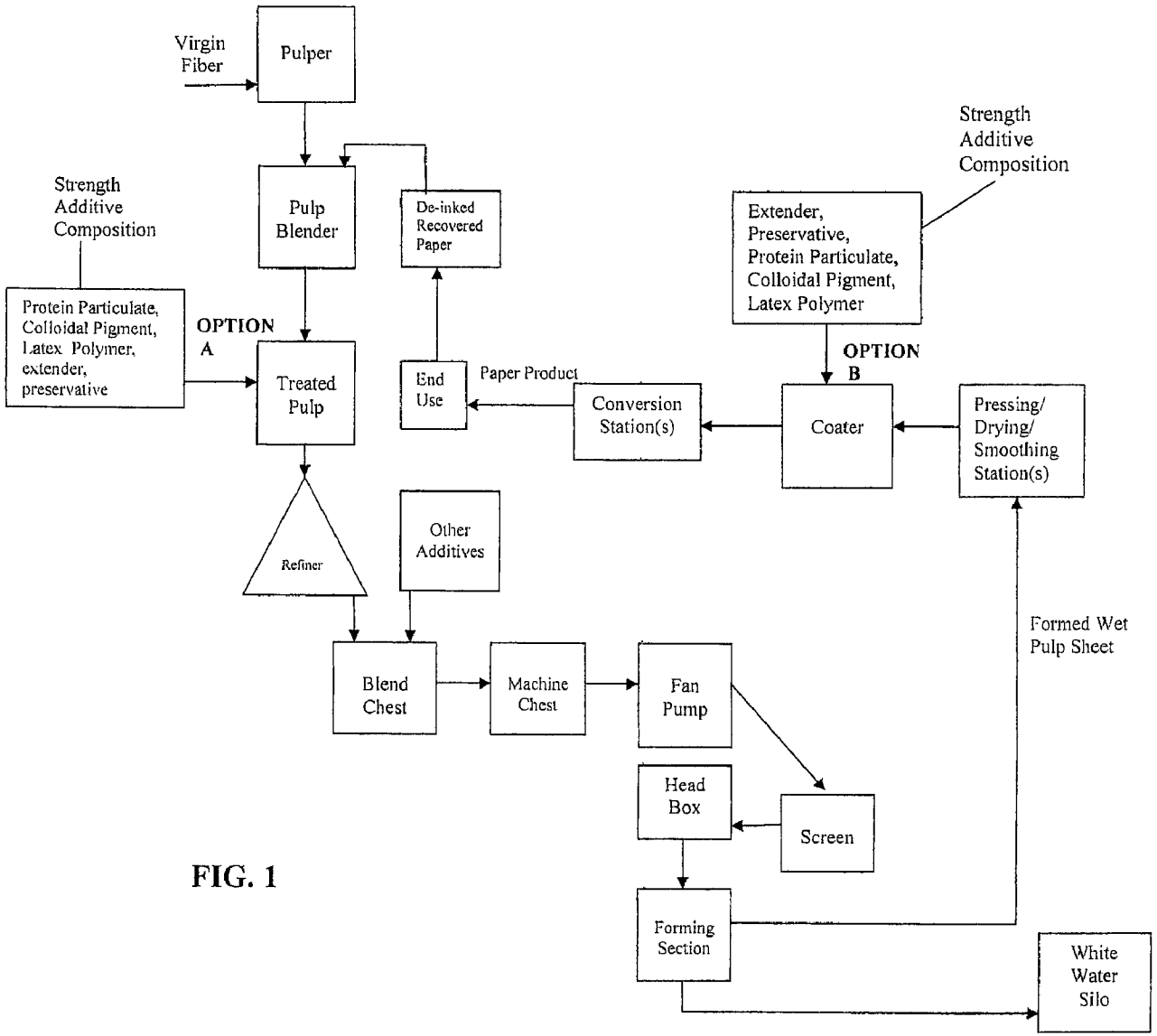
FIG. 1 is a flow chart showing a paper making process according to an embodiment of the present invention.

In the system of FIG. 1, under Option A, a supply of composition comprising protein particulate, colloidal pigment and latex polymer, is combined at a desired concentration with a flowing stream of paper making pulp to form a treated pulp. The supply of the composition can be, for example, a holding tank having an outlet in communication with an inlet of a treated pulp tank. The supply of pulp shown represents a flow of pulp, as for example, supplied from a pulp holding tank or silo. The supply of pulp shown in FIG. 1 can be a conduit, holding, or mixing tank, or other container, passageway, or mixing zone for the flow of pulp. As illustrated, it also may combine virgin fiber pulp and/or pulp made from recycled paper. The method can employ many different types of paper making pulp or combinations thereof. For example, the pulp may comprise virgin and/or recycled pulp, such as virgin sulfite pulp, broke pulp, a hardwood kraft pulp, a softwood kraft pulp, mixtures of such pulps, and the like.

There are a variety of mechanical pulping methods to which this invention can be applied. For example, thermomechanical pulp (TMP) uses a combination of heated wood chips and mechanical processes. Stone Groundwood (SOW) grinds or macerates the wood chips. Chemithermomechanical pulp (CTMP) uses a variety of chemicals, heat, and grinding techniques to produce pulp. Different types of pulp require different types of paper although many papers can use a combination or "blend" of several different types of pulp and recycled/recovered paper. These pulp formulations can be referred to as fiber furnishes.

The pulp treated with the composition is passed from the treated pulp tank through a refiner and then through a blend chest where optional additives are combined with the treated pulp. The refiner has an inlet in communication with an outlet of the treated pulp tank, and an outlet in communication with an inlet of the blend chest. As indicated, the pulps or stocks of the present invention may be treated with one or more other optional additives at the blend chest, or other locations within the system. These optional additives may include, e.g., polymers such as cationic, anionic and/or non-ionic polymers, clays, other fillers, dyes, pigments, defoamers, pH adjusting agents such as alum, sodium aluminate, and/or inorganic acids, such as sulfuric acid, microbiocides, cationic colloidal alumina microparticles, coagulants, flocculants, and/or other conventional and non-conventional papermaking or processing additives.

According to the embodiment of FIG. 1, the pulp treated in the blend chest is passed from an outlet of the blend chest through a connected pipe (communication) to an inlet of a machine chest. The blend chest and machine chest can be of any conventional type known to those skilled in the art. The machine chest ensures a level head, that is, a constant pressure on the treated pulp or stock throughout the downstream portion of the system, particularly at the head box. In the system of FIG. 1, headbox furnish pulp is drained on a forming wire. Any pulp fibers drained through the wire are recirculated to the white water silo. Pulp collected on the forming wire screen is further drained, pressed, and dried before it is conveyed to a winder and is further conveyed to either paper sheeting or is conveyed to coating and conversion stations, such as indicated in FIG. 1.

Under Option B, a supply of the composition comprising protein particulate, colloidal pigment and latex polymer, is included in a coating applied to at least one (or two) major surface(s) of the paper sheeting at a desired coating rate. The composition used for Option B may be sourced from the same or a different supply as that used for practicing Option A. In an alternative embodiment, both of Options A and B are used to impart the composition internally and externally to the paper products.

In one embodiment, the compositions used for Option A and Option B each comprise from about 10 to about 40 weight % protein particulate, from about 10 to about 40 weight % colloidal pigment, from about to about 40 weight % synthetic latex polymer, and from about 0.1 to about 2.0 weight % preservative, on a total dry weight basis. In another embodiment, where a portion of the colloidal pigment is replaced by extender, there is a composition used for Option A and Option B, which each comprise from about 20 to about 40 weight % protein particulate, from about 10 to about 30 weight % colloidal pigment, from about 20 to about 40 weight % synthetic latex polymer, from about 0.1 to about 2.0 weight % preservative, and from about 5 to about 30 weight % extender, on a total dry weight basis.

The composition can be prepared as a physically stable dispersion, which can be more stable at from about 8 weight % to about 12 weight % total solids, particularly from about 9 to about 11 weight % total solids, and more particularly about 10 weight % total solids. At about 10 weight % total solids the viscosity tends to stay in a pourable range. Higher solids levels may tend to gradually thicken during any storage before use. The order of addition in preparing the dispersion can have some effect on physical stability. More stable dispersions can be made by first adding the pigment, followed by the protein particulate, and then adding the latex. If preservatives are used, it has been found that they work best if added first into the water used to make the filler dispersion. If the pigment extender is used, it can be added after the pigment and prior to the protein particulate and latex polymer. Some extenders, such as Wollastonite, require some time and mixing to completely wet out so preferably it is mixed thoroughly for at least about 20 minutes in smaller batches before the final addition of the latex polymer.

The various ingredients that comprise the compositions of the present invention can be mixed together using conventional mixing techniques, such as a mixer, blender, stirrer, and/or an open vessel. The order of addition of the ingredients that comprise the compositions can be, for example, in the following sequence: 1) water, 2) preservative, 3) dry colloidal pigment, 4) protein particulate, and 5) latex polymer. Addition of the latex near the end of the batching process can be desirable to reduce or avoid a tendency of the latex to agglomerate, which can entail increased mixing requirements. Alternatively, for example, the ingredients that comprise the composition can be added all at the same time, sequentially, two or more components that comprise the composition can be pre-combined prior to their addition to the remaining components, and so on. The compositions of the present invention can be prepared as masterbatches for dilution at a later time or the desirable concentration can be made at the same time that the composition is prepared. The composition can be prepared on-site or off-site or parts or components of the composition can be prepared or pre-mixed off-site or on-site prior to the ultimate formation of the composition. The compositions of the present invention can be formed immediately prior to their introduction into the papermaking process or sheet making process, or the compositions can be prepared beforehand, such as before use, minutes before use, hours before use, or days or weeks or months before use, and preferably within about 2-3 weeks of usage. For instance, the compositions can be made 1 to 100 seconds before their introduction into the papermaking process, or from 1 hour to 5 hours, or from 1 hour to 10 hours, or 1 hour to 24 hours before use, or from 1 day to 7 days, or 1 day to 30 days before use. The composition or components thereof can be introduced into the papermaking process in Option A and/or B by applying the composition as a pre-mixed composition. Alternatively, components of the composition can be introduced in any fashion into the papermaking process, such as sequentially, as a masterbatch, as part of a feedstream which ultimately feeds into one or more locations of the papermaking process, or two or more components pre-mixed can be introduced alone, and one or more of the remaining components can be introduced separately, or ultimately, the composition is formed in a holding tank, feedstream, and/or one or more locations of the papermaking process.

Although FIG. 1 indicates the composition is introduced to the pulp immediately after the pulp blending tank or chest, and/or as a surface treatment of paper sheeting via a coater, the composition can generally be added at any location (or multiple locations) of the paper making process. For pulp treatment, preferably it is added prior to the whitewater silo in a paper making process, and more preferably is added prior to the machine chest and even more preferably is added prior to the blend chest, and most preferably, the composition is added prior to the first refiner in a paper making process, which is generally located before the blend chest. Under Option A, the composition may be added to the pulp in an amount of at least about 0.1 dry pound per ton of pulp, based on the dried solids weight of the pulp, particularly from about 0.25 to about 5 dry pounds per ton, more particularly from about 0.5 to about 1.5 dry pounds per ton, and even more particularly from about 0.8 to about 1.2 dry pounds per ton, in paper furnish. Under Option B, the coating rate of the composition applied to base paper is generally from about 0.5 $g/m^2$ to about 40 $g/m^2$, particularly from about 2 $g/m^2$ to about 15 $g/m^2$, on a dry weight basis.

Similarly, other pulp additives, e.g., cationic polymers, pH adjustment agents, etc., can be added at other points along the flow of pulp or treated pulp through the system shown in FIG. 1. The paper making system can also include metering devices (not shown) for providing a suitable concentration of the composition to the flow of pulp. Other metering or dosing devices are preferably provided for the other additives and ingredients that may be used during the method. For example, the pH of the (treated) pulp can be, but not exclusively, controlled to a defined level of from about 4.0 to about 8.5, and more suitably from about 4.5 to about 8.0.

Protein Particulate. The protein particulate component of the composition used to treat the pulp or paper sheeting according to this invention preferably may comprise plant-sourced, animal-sourced, or synthetic proteinaceous particulates. It more preferably comprises dry comminuted defatted legume seeds. The legume family, Fabacea, includes, e.g., soy beans and other beans, peas, and peanuts. Defatted soy particulates are most preferred, and these may comprise defatted soy flour, defatted soy concentrate powders, defatted soy isolate powders, and/or powdered hydrolyzed derivatives of these defatted soy products. The protein particulates should have a size and specific gravity allowing them to be readily dispersed and stay dispersed in aqueous compositions used in paper coating or pulping, without significant flotation or sedimentation. Defatted soy protein particulates passing through 200 mesh, are generally preferred.

One process suitable for providing defatted soy flour comprises cracking soybeans to remove the hull, rolling them into flakes with flaking machines, and defatting the flakes with a suitable solvent, such as hexane. Suitable flaking machines consist of a pair of horizontal counter-rotating smooth steel rolls. The rolls are pressed one against the other by means of heavy springs or by controlled hydraulic systems. The soybeans are fed between the rolls and are flattened as the rolls rotate one against the other. The roll-to-roll pressure can be regulated to determine the average thickness of the flakes. The rolling process disrupts the oil cell, facilitating solvent extraction (i.e., hexane) of the oil. Specifically, flaking increases the contact surface between the oilseed tissues and the solvent. Once the flakes are defatted, thereby removing the soybean oil, the defatted flakes are dried and milled into flour. Defatted soy flour typically contains less than 1 wt % oil (e.g., 0.001 wt % to 0.95 wt % oil).

Commercially available sources of defatted soy flour include, for example, Prolia™ Defatted Soyflour, Cargill, Minneapolis Minn., which has at least 50% protein content, a protein dispersability index of 65-75%, 8% maximum moisture, and at least 95% is −200 mesh U.S. sieve size.

Colloidal Pigment. The pigment dispersion component of the composition used to treat the pulp or paper sheeting according to this invention is preferably in the form of a colloidal solution or slurry. Pigment particles may be obtained as, or prepared by, pulverize-dispersing agglomerate pigment particles by mechanical means, which may be performed in the presence of aqueous resins or binders conventionally used for this preparation, until the average particle size of the pulverize-dispersed particles reaches 1 micrometer or less, preferably 500 nm or less (e.g., 1 nm to 1 μm or 10 nm to 500 nm) highly concentrated pigment dispersions for pulp and paper applications that are available in a wide palette of fluorescent and standard colors. To obtain the pulverize-dispersed agglomerate pigment particles having an average particle size of 1 micrometer or less, conventional agglomerate pigment particles having an average particle size of 1 to 50 micrometers may be subjected to a mechanical pulverizing procedure under a high shearing force. For example, a size reduction method in which a material in the form of lumps is finely divided is applied to the conventional agglomerated pigment particles. The mechanical pulverizing means include ultrasonic pulverizers, high speed rotation mills, roll mills, container-driven medium mills, medium stirring mills, jet mills, mortars, sand grinders, pressure-type homogenizers and Cowles dispersers.

Colloidal pigment formulations, such as those prepared in the above manners, comprise from about 30% (by weight formulation) to about 75% (by weight formulation) total non-volatile solids, with the balance being water. A major amount, and up to 100% thereof of the non-volatile solids is the pigment content. The amount of total solids in the colloidal pigment formulation can affect the physical properties of the final coated paper product. The application of pigmented coatings containing as high in weight percent solids as is practical improves smoothness, gloss, and print quality. Additionally, the rheological properties of colloidal pigment formulations are directly influenced by solids content, which in turn directly affects coating processes. For example, when the solids content of a coating formulation is increased, the measured viscosity of the coating formulation is increased. This can affect the speed of the coating machine, as well as energy requirements to dry coating/paper structures.

The pigment or pigments present in the colloidal pigments tend to fill in irregularities in the paper surface. This results in a more even and uniformly absorbent surface for printing and improves the overall visual appearance of the coated sheet. The choice of pigments to be used in the aqueous pigmented coating formulations described herein is based on the resulting properties desired in the paper product surface and can be chosen by one skilled in the art.

Suitable exemplary pigments for use in the colloidal pigment formulations include inorganic pigments such as silicates (e.g., hydrous sodium lithium magnesium silicate modified with tetra sodium pyrophosphate, hydrous sodium lithium magnesium silicate, aluminum silicate, magnesium silicate), calcium carbonate (e.g., synthetic, precipitated material, or ground from naturally occurring mineral), calcined kaolin, hydrous kaolin, clay (e.g., China clay, calcined clay), talc, mica, dolomite, silica (e.g., amorphous silica), zeolite, gypsum, satin white, titania, metal oxides (e.g., titanium dioxide, zinc oxide, tin oxide, magnesium oxide), calcium sulfate, barium sulfate, magnesium sulfate, aluminum trihydrate, zinc oxide, tin oxide, aluminum oxide, quasi-boehmite, satin white, smectite, zeolite, diatomaceous earth pigments, lithopone, blanc fixe; and organic pigments such as plastic pigments (e.g., styrene resin), urea resin, and benzoguanamine resin pigments; or any combinations thereof. Some of the pigments exhibit an ionic property and are influenced by pH. Usually, the inorganic pigments except for the alumina pigments are anionic pigments. Coating pigments suitable for use in the colloidal pigment formulation are well known to those skilled in the art and disclosed, for example, in U.S. Pat. No. 6,030,443, issued to Bock, et al. (Feb. 29, 2000) and U.S. Pat. No. 5,766,331, issued to Krinski, et al. (Jun. 16, 1998), both of which are incorporated in their entirety by reference.

Commercially available sources of the colloidal pigment include, for example, synthetic hectorite, such as Laponite® RDS, which is a synthetic layered silicate incorporating an inorganic polyphosphate peptiser, and Laponite® DS, which is a hydrous sodium lithium magnesium silicate modified with tetra sodium pyrophosphate, and Laponite® D, Laponite® RD, or Laponite® ED, which are hydrous sodium lithium magnesium silicates, all from Southern Clay Products, Inc., Gonzales Tex.

Latex Polymers. The latex polymer component of the composition used to treat the pulp or paper sheeting according to this invention preferably may be selected, e.g., from among acrylics, vinyl acrylates, alkyl acrylate-vinyl acetate copolymers, carboxyl alkyl acrylate-vinyl acetate copolymers, styrene acrylates, styrene butadiene copolymers, carboxyl styrene-butadiene copolymers, styrene acrylonitriles, polyvinyl acetates, vinyl polyacetates, and/or carboxyl vinyl polyacetates, and/or combinations thereof. Examples of compositions containing aqueous latex binders of synthetic polymer for paper and board coatings are provided, e.g., in U.S. Pat.

No. 4,294,704, which are incorporated herein by reference. These latex polymers are preferably used in aqueous emulsion form.

Commercially available sources of the acrylic emulsions include, for example, HYCAR® 2671, from Noveon, Inc., Cleveland Ohio, and Acrygen® 1970D, from Omnova Solutions Inc., Fitchburg, Mass.

Preservative. A preservative generally is included in the composition since the protein-containing compositions are biopolymer dispersions subject to microbial degradation. A preservative, for example, a mild food preservative, can be contained in an effective antimicrobial amount in compositions of the present invention. The targeted microbes are bacteria and/or fingi. The preservative is used singly or in combinations of different preservatives in an amount(s) effective to impart microbial control.

The preservative may be selected, for example, from isothiazolines, propyl 4-hydroxybenzoate, butylated hydroxyanisole, and isothiazolinones, or combinations thereof. Isothiazolinones include, for example, 5-chloro-2-methyl-4-isothiazolin-3-one, 2-methyl-4-isothiazolin-3-one, or combinations thereof. Commercially available sources of the preservative include, for example, isothiazolines such as Busan® 1078, and Busan® 1218, from Buckman Laboratories International, Inc., Memphis Term., and, for example, isothiazolinones such as Kathon® CF1400 and Kathon® CF150, from Rohm & Haas. Inoculation levels for the isothiazolines can be, for example, from about 500 to about 3500 ppm. Other amounts can be used. Another preservative is p-hydroxypropyl benzoate, available as Propyl Paraben, CAS Number 94-13-13, from Mallinckrodt Inc., St. Louis Mo. Dosage levels for the Propyl Paraben can be, for example, about 1%. Preferably, the Propyl Paraben and isothiazolines are used in combination to provide a balance of antimicrobial action. Another preservative is butylated hydroxyanisole (1,1-dimethylethyl)-4-methoxyphenol), available as BHA, from Sciencelab.com, Inc., Houston Tex. Inoculation levels for the BHA can be, for example, from about 200 to about 2500 ppm.

Pigment Extender. It also has been discovered that certain filler materials can be used to extend the pigment, a relatively higher cost ingredient, without detracting from the strength of the paper made with the composition. The pigment extender may comprise calcium metasilicate or $CaSiO_3$, and synthetic or natural sources thereof, for example, Wollastonite. Natural Wollastonite (CAS Number 13983-17-0) can be used as the extender. The amount of pigment that can be replaced by Wollastonite in the composition generally ranges from 0 to about 65 wt %, particularly from about 25 wt % to about 50 wt %, without significant adverse impacts on the composition stability and paper strength.

Commercial sources of Wollastonite (calcium silicate) include, for example, NYAD®, NYGLOSS®, RIMGLOSS®, NYCOR®, ULTRAFIBER®, from NYCO® Minerals, Inc., Willsboro, N.Y.

Other Pulp Treatment Composition Features. For internal additive applications (i.e., Option A), in addition to the protein particulate, pigment, latex binder, and preservative (and any extender) of the composition of the present invention, one or more conventional additives may also be included in the composition per se to enhance or tailor performance attributes of the formulation. These optional additives of the composition, for example, can be pH-adjusters, levelling agents, lubricants, defoamers, wetting agents, optical brighteners, pigment-dispersing agents, cross-linkers, water retention aids, viscosity modifiers or thickeners, and/or combinations thereof. Defoamers can be important to prevent excessive foaming and entrapped air during product formulation. A commercial source of defoamers suitable for this purpose is, for example, Bubreak® 4452, from Buckman Laboratories International, Inc., Memphis Tenn.

Following aqueous dispersion of the protein particulate, pigment, and latex polymer, the pH of the resulting combination can be controlled to a defined level of from about 7.0 to about 10.0, and more suitably from about 8.0 to about 9.0. Adjustment of pH of the composition is most commonly accomplished through the addition of either sodium hydroxide or ammonium hydroxide (aqueous ammonia).

Other Coating Composition Features. For surface treatment applications (i.e., Option B), the coating composition may further include conventional paper coating additives. For example, the coating composition may include a binder in addition to the protein particulate, colloidal pigment, and latex polymer. For purposes herein, "coated paper" refers to paper which has a special coating applied to its surface, wherein the coating material may comprise the inventive composition, clay, casein, bentonite, and/or talc, etc., applied by means of roller, spray, or brush applicators, and the like. The coating can include conventional brightening agents, opacifying agents, etc. As used herein, the term "paper product" means paper or paperboard having a basis weight of from about 30 $g/m^2$ to about 600 $g/m^2$. Typically, when the paper product is paper, the paper product will have a basis weight of from about 30 $g/m^2$ to about 200 $g/m^2$. When the paper product is paperboard, the paper product will typically have a basis weight of from about 200 $g/m^2$ to about 600 $g/m^2$.

Generally, the coating version of the inventive composition can be applied to one or more sides of the paper product by any means known in the art. For example, paper coating methods include, but are not limited to, roll applicator and metering with roll, rod, blade, bar, air knife; pond applicator and metering with roll, rod, blade, bar, or air knife; fountain applicator and metering roll with roll, rod, blade, bar, or air knife; pre-metered films or patterns, such as gate roll, three-roll, anilox, gravure, film press, curtain, spray; and foam application. In one suitable embodiment, the paper product is fed through a rolling nip in which one of the rolls has been previously coated with the inventive composition formulation. The coating formulation is transferred to the paper product's surface. The excess coating formulation is removed from the surface of the paper product, for instance, using a steel trailing blade which creates a level coating profile on the surface of the sheet of the desired final add-on coating weight. The resulting coated paper product produced has an improved water/ink holdout and strength as compared to an uncoated paper product.

The advantages and benefits of the present invention include improved surface strength and surface holdout of liquids for paper and paperboard. Surface and internal strength properties of paper and paperboard are improved. Use of the inventive compositions also may improve retention of functional additives. Improved repulpability is also achieved of paper and paperboard treated with the inventive compositions as surface and/or internal additives. The inventive compositions also allow higher loading of surface or internal pigments in paper and paperboard, and, they also can improve the brightness of certain pulps used in paper and paperboard.

The present invention will be further clarified by the following examples, which are intended to be purely exemplary of the present invention, in which parts are proportions by weight unless otherwise specified.

EXAMPLES

Example 1

The strength and water holdout properties of compositions exemplifying the present invention were examined.

A test composition was prepared having the following formulation:

| Composition Components | Amt. % (wt) |
|---|---|
| Silicate[1] | 1.7 |
| Wollastonite[2] | 1.7 |
| Defatted soyflour[3] | 3.3 |
| Latex polymer[4] | 6.3 |
| Preservative a[5] | 0.3 |
| Preservative b[6] | 1.0 |
| Defoamer[7] | 0.2 |
| Water | 85.5 |
| Total | 100 |

[1]Laponite ® RDS;

[2]Wollastonite as NYCO NYAD 1250 ® Wollastonite (USA) or NYCO NYAD M1250 ® Wollastonite (Mexico);

[3]Prolia ®;

[4]Hycar ® 2671;

[5]Busan ® 1078;

[6]Propyl Paraben (propyl 4-hydroxybenzoate);

[7]Bubreak ® 4452.

The composition components were combined with the following order of addition and mixing times.

| Order of Addition and Mixing Times | Amt. % (wt) |
|---|---|
| Water (start mixing) | 40.0 |
| Preservative a (Add, mix 5 minutes) | 0.33 |
| Preservative b (Add, mix 10 minutes) | 1.0 |
| Silicate (Add, mix 15 minutes) | 1.7 |
| Wollastonite (Add, mix 20 minutes) | 1.7 |
| Defoamer (Add, keep mixing) | 0.2 |
| Water (Add, keep mixing) | 45.5 |
| Defatted soyflour (Add, mix 15 minutes) | 3.3 |
| Latex polymer (Add, mix 20 minutes) | 6.29 |
| Total | 100 |

The composition was a 10% solids preparation. The composition was applied at a dosage rate to pulp furnish at a rate of 1 dry pound per ton of fiber, and was incorporated at the introduction point indicated by Option A in FIG. 1. The treated pulp was comprised of either 100% virgin kraft pulp or virgin kraft with up to 50% recovered kraft pulp.

A control composition was prepared that was similar to the preceding composition with the following differences: 3.3% silicate, no Wollastonite.

TMP furnishes were prepared using the exemplary composition and the control composition, according to the general process scheme of FIG. 1. Multiple tests, designated 1-3, were performed using the exemplary composition. Hand sheets tests were performed using 100% virgin kraft pulp and the results are set forth in the following tables.

| Composition | CD Tear (g force) | MD tear (g force) | CD tensile (KN/m) | MD tensile (KN/m) | Water drop (sec) | Sheet Brightness |
|---|---|---|---|---|---|---|
| Control | 38.9 | 39 | 1.85 | 1.73 | 26 | 50 |
| 1 | 37.2 | 35.6 | 1.92 | 1.96 | 37 | 51 |
| 2 | 37.6 | 40.6 | 1.59 | 1.76 | 46 | 49 |
| 3 | 34.2 | 41 | 1.43 | 2.05 | 58 | 49 |

| Composition | CD Elongation (%) | MD elongation (%) | CD TEA ($j/m^2$) | MD TEA ($j/m^2$) | Wet tensile (KN/m) |
|---|---|---|---|---|---|
| Control | 1.85 | 1.65 | 19.78 | 16.74 | 0.76 |
| 1 | 1.94 | 1.82 | 22.66 | 21.54 | 0.8 |
| 2 | 1.68 | 1.63 | 13.09 | 14.19 | 0.64 |
| 3 | 1.83 | 2.02 | 16.1 | 22.16 | 0.74 |

Example 2

Handsheet studies with British sheet mold handsheets were used for additional product screening and testing. Surface treatment of copy paper was conducted to check Hercules Sizing Test using acidic ink (HST) and water drop holdout. A series of furnishes were prepared which were surface-coated at a rate of about 2 to 5 $g/m^2$, on a dry solids basis, such as indicated as Option B in FIG. 1, with different compositions formulated as indicated in the following table. The treated pulp was comprised of 100% virgin kraft (50/50 hardwood/softwood) pulp and, in some cases, up to 50% recovered kraft pulp.

Compositions C1-C6 are comparison compositions and Compositions 1-6 are exemplary of the present invention.

| Composition | Composition Components |
|---|---|
| C1 | PSB10/A |
| 1 | PSB10/A/B |
| C2 | PSB24/A |
| 2 | PSB24/A/B |
| C3 | PSB25/A |
| 3 | PSB25/A/B |
| C4 | PSB27/A |
| 4 | PSB27/A/B |
| C5 | PSB29/A |
| 5 | PSB29/A/B |
| C6 | MP810/A |
| 6 | MP810/A/B |

The PSB's are experimental colloidal silicas. PSB10 comprises pure silica particles, 4.2 wt %. PSB24 comprises silica and a small amount of sodium phosphate, 5.3 wt %. PSB25 comprises silica, sodium phosphate, and $MgCl_2$, 5.3 wt %. PSB27 comprises silica, $MgCl_2$, and aminotri(methylene phosphonic acid) (AMP), 5.3 wt %. PSB29 comprises silica and 3-chloro-2-hydroxypropyltrimethylammonium chloride (Dow Quat 188), 6.0 wt %. The particles size of the colloidal silicas of PSB10 and PSB24 are different from each other. Component "MP810" is synthetic silicate (Laponite® RDS). Component "A" is a biopolymer dispersion comprised of a 1:1 silicate:defatted soy flour combination in water, as a formulation comprising 7.5 wt % Laponite® RDS, 7.5 wt %

Figure 2:
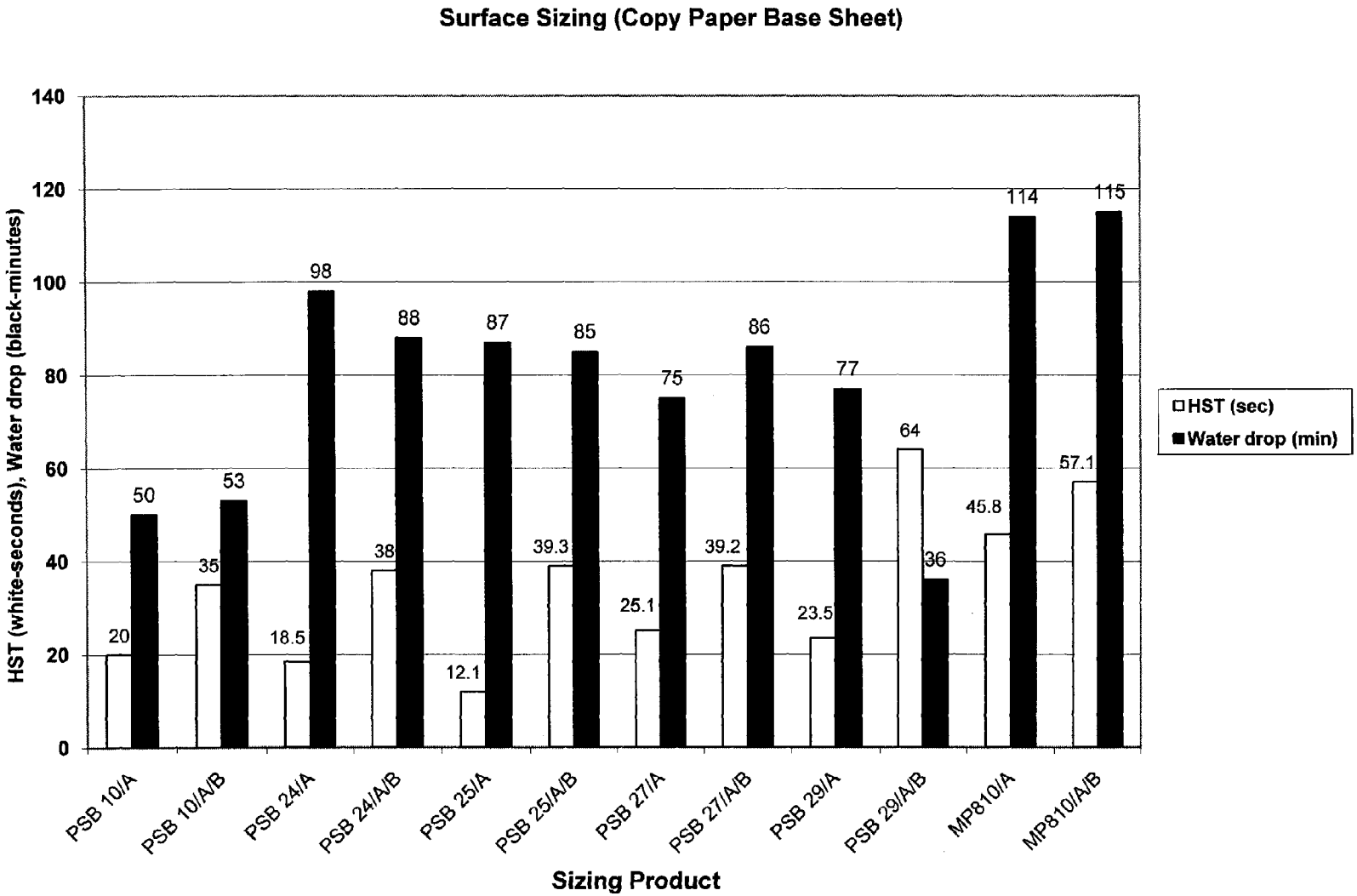
FIG. 2 is a bar chart showing Hercules Sizing Test (HST) and water drop holdout test results for handsheets made from furnishes representing the present invention and comparison samples.

Prolia SF®, and 85 wt % water. Component "B" is polyvinyl acetate latex (Hycar® 2671). All compositions are at 12% solids. The results of HST and water drop holdout measurements for these papers are set forth in FIG. 2.

The PSB's are experimental colloidal silicas. The particles size of the colloidal silicas of PSB10 and PSB24 are different from each other. Component "MP810" is synthetic silicate (Laponite® RDS). Component "A" is a biopolymer dispersion comprised of 1:1:1 silicate:defatted soy flour:water (7.5 wt % Laponite® RDS:7.5 wt % Prolia SF®:85 wt % water). Component "B" is a polyvinyl acetate latex (Hycar® 2671). All compositions are at 12 wt % solids. The results of HST and water drop holdout measurements for these papers are set forth in FIG. 2.

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

It will be apparent to those skilled in the art that various modifications and variations can be made to the embodiments of the present invention without departing from the spirit or scope of the present invention. Thus, it is intended that the present invention covers other modifications and variations of this invention provided they come within the scope of the appended claims and their equivalents.

What is claimed is:

1. A composition for treating paper products comprising protein particulate, colloidal pigment, synthetic latex polymer, and preservative, wherein the composition is an aqueous dispersion containing from about 8 weight % to about 12 weight % total solids.

2. The composition of claim 1, further comprising pigment extender.

3. The composition of claim 1, said composition comprising from about 10 to about 40 weight % protein particulate, from about 10 to about 40 weight % colloidal pigment, from about 10 to about 40 weight % synthetic latex polymer, from about 0.1 to about 2.0 weight % preservative, on a total dry weight basis.

4. The composition of claim 1, said composition comprising from about 20 to about 40 weight % protein particulate, from about 10 to about 30 weight % colloidal pigment, from about 20 to about 40 weight % synthetic latex polymer, from about 0.1 to about 2.0 weight % preservative, and from about 5 to about 30 weight % pigment extender, on a total dry weight basis.

5. The composition of claim 1, wherein said protein particulate comprises defatted legume flour.

6. The composition of claim 1, wherein said protein particulate comprises defatted soy flour.

7. The composition of claim 1, wherein said colloidal pigment is calcium carbonate, calcined kaolin, hydrous kaolin, China clay, talc, mica, dolomite, silica, silicate, zeolite, gypsum, satin white, titania, titanium dioxide, calcium sulfate, barium sulfate, aluminum trihydrate, lithopone, blanc fixe, plastic pigment, or combinations thereof.

8. The composition of claim 1, wherein said synthetic latex polymer is styrene butadiene copolymer, carboxyl styrene-butadiene copolymer, styrene acrylate, styrene acrylonitrile, vinyl acrylate, acrylic, polyvinyl acetate, vinyl polyacetate, carboxyl vinyl polyacetate, alkyl acrylate-vinyl acetate copolymer, or carboxyl alkyl acrylate-vinyl acetate copolymer, or combinations thereof.

9. The composition of claim 1, wherein said preservative is isothiazoline, propyl 4-hydroxybenzoate, butylated hydroxyanisole, or combinations thereof.

10. The composition of claim 4, wherein said extender comprises calcium silicate.

11. The composition of claim 1, wherein the colloidal pigment has an average particle size of from 1 nm to 500 nm.

12. A method of treating paper or paper board by applying the composition of claim 1 to at least one of i) at least one surface of a formed paper or paper board sheet, ii) a paper or paper board making pulp prior to draining.

13. The method of claim 12, said composition comprising from about 20 to about 40 weight % protein particulate, from about 20 to about 40 weight % colloidal pigment, from about 20 to about 40 weight % synthetic latex polymer, and from about 0.1 to about 2.0 weight % preservative, on a total dry weight basis.

14. The method of claim 12, said composition comprising from about 20 to about 40 weight % protein particulate, from about 10 to about 30 weight % colloidal pigment, from about 20 to about 40 weight % synthetic latex polymer, from about 0.1 to about 2.0 weight % preservative, and from about 5 to about 30 weight % pigment extender, on a total dry weight basis.

15. The method of claim 12, wherein said protein particulate comprises defatted legume flour.

16. The method of claim 12, wherein said protein particulate comprises defatted soy flour.

17. The method of claim 12, wherein said colloidal pigment is a silicate, calcium carbonate, calcined kaolin, hydrous kaolin, China clay, talc, mica, dolomite, silica, zeolite, gypsum, satin white, titania, titanium dioxide, calcium sulfate, barium sulfate, aluminum trihydrate, lithopone, blanc fixe, plastic pigment, or combinations thereof.

18. The method of claim 12, wherein said synthetic latex polymer is styrene butadiene copolymer, carboxyl styrene-butadiene copolymer, styrene acrylate, styrene acrylonitrile, vinyl acrylate, acrylic, polyvinyl acetate, vinyl polyacetate, carboxyl vinyl polyacetate, alkyl acrylate-vinyl acetate copolymer, carboxyl alkyl acrylate-vinyl acetate copolymer, or combinations thereof.

19. The method of claim 12, wherein said preservative is an isothiazoline, propyl 4-hydroxybenzoate, butylated hydroxyanisole, or combinations thereof.

20. The method of claim 14, wherein said extender comprises calcium silicate.

21. The method of claim 12, wherein the composition is applied to at least one surface of a formed paper or paper board sheet.

22. The method of claim 12, wherein the composition is applied to at least one surface of a base paper at a coating rate of from about 0.5 $g/m^2$ to about 40 $g/m^2$, on a dry weight basis.

23. The method of claim 12, wherein the composition is applied to a paper or paper board making pulp prior to draining, and forming the treated pulp into paper or paperboard.

24. The method of claim 23, wherein said composition is added to said pulp in an amount of at least about 1 dry pound per ton of pulp, based on dry weight thereof.

25. A treated paper product made from a drained paper web, said paper web comprising a treated pulp, said treated pulp comprising cellulosic fibers, and a composition comprising protein particulate, colloidal pigment, synthetic latex polymer, and preservative, wherein the composition is added to pulp in an amount of from about 0.25 to about 5 dry pounds per ton of pulp, based on dried solids weight of the pulp, in providing said treated pulp.

* * * * *